US007331628B2

(12) United States Patent
Lin

(10) Patent No.: US 7,331,628 B2
(45) Date of Patent: Feb. 19, 2008

(54) FOLDING CHAIR WITH SAFETY FOLDING DEVICE

(76) Inventor: Wei-Chi Lin, No. 725, Ta Yeh Rd., Taipei, Peitou (TW) 11268

( * ) Notice: Subject to any disclaimer, the term of this patent is extended or adjusted under 35 U.S.C. 154(b) by 0 days.

(21) Appl. No.: 11/161,026

(22) Filed: Jul. 20, 2005

(65) Prior Publication Data

US 2007/0029844 A1 Feb. 8, 2007

(51) Int. Cl.
*A47C 4/00* (2006.01)

(52) U.S. Cl. ..... 297/16.2; 297/16.1; 297/56; 297/55; 297/440.22

(58) Field of Classification Search ..... 297/16.1, 297/16.2, 55, 56, 440.22
See application file for complete search history.

(56) References Cited

U.S. PATENT DOCUMENTS 4,892,327 A * 1/1990 Cabagnero ..... 280/650
5,253,921 A * 10/1993 Boulet ..... 297/32
5,954,391 A * 9/1999 Gray ..... 297/58
6,354,657 B1 * 3/2002 Nelson et al. ..... 297/56
6,454,348 B1 * 9/2002 Wu ..... 297/16.2
6,478,375 B2 * 11/2002 Richardson ..... 297/248
6,511,122 B1 * 1/2003 Chen ..... 297/16.2
6,536,079 B2 * 3/2003 Hill ..... 16/326
6,595,582 B1 * 7/2003 Liu ..... 297/35
6,607,240 B2 * 8/2003 Zheng ..... 297/16.2

* cited by examiner

*Primary Examiner*—David Dunn
*Assistant Examiner*—Erika Garrett
(74) *Attorney, Agent, or Firm*—Alan Kamrath; Kamrath & Associates P.A.

(57) ABSTRACT

A folding chair with safety folding device comprises a safety hook, a pin, a torsion spring, a bottom cover, a seat, a back, a pair of front legs, a pair of rear legs, a front crossbar, a rear crossbar and a pivotal shaft. The safety hook is employed to position the pair of rear legs after the folding chair is unfolded, when the folding chair is being folded, the pair of rear legs can be released safely by pressing the safety hook, thus preventing an undesired pinching injury as a result of improper operation or impact.

8 Claims, 9 Drawing Sheets

FOLDING CHAIR WITH SAFETY FOLDING DEVICE

BACKGROUND OF THE INVENTION

1. Field of the Invention

The present invention relates to a folding chair, and more particularly to a folding chair with safety folding device.

2. Description of the Prior Art

A conventional folding chair's advantage is easy foldable and space saving, however, it also has disadvantages since the structure of the folding chair is kept in an unsteady balance during the unfolding process. In this situation, the unfolding force applied to the folding chair should be controlled appropriately, otherwise, there is a risk of a pinching injury to the user.

The lack of safety measure on the conventional folding chair is likely to cause potential danger to the children, therefore, the folding chair is better to have a safe unfolding device. FIG. 9 shows a conventional folding chair. When force is applied to the rear portion of the seat 5 of the folding chair, the front portion of the seat 5 will move upward; so that the angle between the front legs 7 and the rear legs 8 and between the rear legs 8 and the seat 5 will be reduced, and as a result, the children is likely to be pinched between these legs 7, 8. In addition, the leverage effect of the folding chair itself will worsen the pinching injury.

The present invention has arisen to mitigate and/or obviate the afore-described disadvantages.

SUMMARY OF THE INVENTION

The primary objective of the present invention is to provide a folding chair with a safety folding device which can be folded safely. When the safety folding device is not actuated, the folding chair is maintained stably in an unfolding state, thus preventing an undesired folding of the folding chair caused by a sudden external force acted on the rear portion of the seat. Besides, the folding chair can be folded easily just by pressing the safety folding device.

The secondary objective of the present invention is to provide a folding chair with a safety folding device that can be unfolded smoothly, that is to say that the safety folding device has an effect for preventing improper folding movement of the folding chair but adds little to the unfolding operation of the folding chair. Therefore, the folding chair can be unfolded easily. In other words, the safety folding device is a one-way safety device.

A folding chair with the safety folding device in accordance with the present invention comprises a safety hook, a pin, a torsion spring, a bottom cover, a seat, a back, a pair of front legs, a pair of rear legs, a front crossbar, a rear crossbar and a pivotal shaft; wherein the safety hook is employed to position the pair of rear legs after the folding chair is unfolded, when the folding chair is being folded, the pair of rear legs can be released safely by pressing the safety hook, thus preventing an undesired pinching injury as a result of improper operation or impact.

The safety hook is a J-shaped unitary structure and is formed at a front end thereof with an arc retaining portion. A pivotal hole is formed at a mid portion of the safety hook is of the safety hook for insertion of a pin, and a press board is formed at a rear portion of the safety hook and operationally pressed by the user.

The arc retaining portion is abutted by an upper lateral pipe connected between the pair of rear legs when the folding chair is being unfolded.

The pin is a cylinder to be inserted in the pivotal hole, and both ends of the pin are located in the bottom cover. A torsion spring is mounted on the pin.

The torsion spring serves to provide a positioning force for positioning the folding chair after the folding chair is unfolded.

The bottom cover is a U-shaped piece mounted to a bottom of the seat and is formed at a front portion thereof with a slot, and both ends of the bottom cover are folded to form a flange that is to be connected to the bottom of the seat of the folding chair.

The front and rear legs of the folding chair serve to support the user together after the folding chair is unfolded.

The back of the folding chair is located at the top of the front legs for backing the user.

The front and rear legs are able to pivot about the pivotal shaft.

The front legs serve to support a weight of a rear portion of the seat, and a front cross bar is attached to a lower portion on the front legs.

The rear legs serve to support a weight of a front portion of the seat, and the upper lateral pipe connected between the pair of rear legs is received in a space between the seat and the bottom cover, and a rear crossbar is attached to a lower portion on the rear legs.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
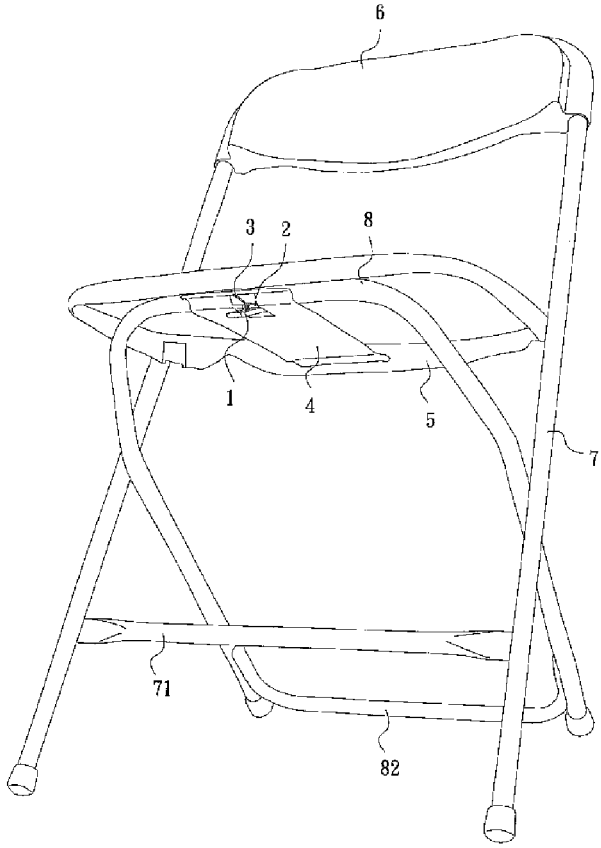
FIG. 1 is a perspective view of a folding chair with safety folding device in accordance with the present invention.
Figure 4:
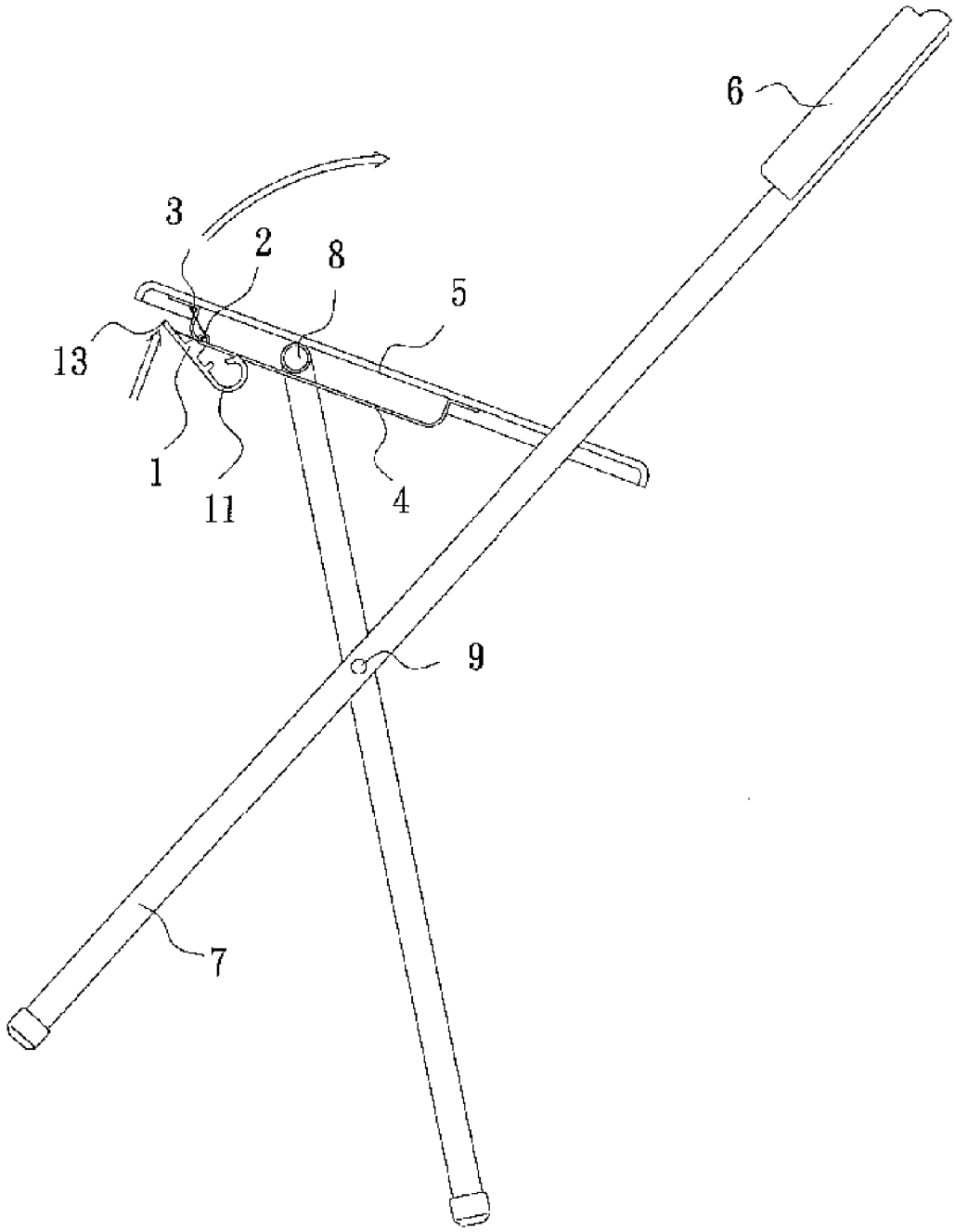
FIG. 4 shows the before-folding state of the folding chair.

Referring to FIG. 1, which is a perspective view of a folding chair with safety folding device in accordance with the present invention, wherein the seat 5, the back 6, the front legs 7, the front crossbar 71, the rear legs 8, the rear crossbar 82 and the pivotal shaft 9 (as shown in FIG. 4) are the same as the components of a conventional folding chair. In addition to these conventional components, the folding chair of the present invention is further provided with a bottom cover 4 on which is defined a groove for allowing a press board 13 at the front end of a safety hook 1 to extend out of the bottom cover 4. A pin 2 is locked in the bottom cover 4, and a torsion spring 3 is mounted on the pin 2 in such a manner that an end of the torsion spring 3 presses against the inner side of the press board 13 and another end of the torsion spring 3 abuts against the flange 41 of the bottom cover 4.

Figure 2:
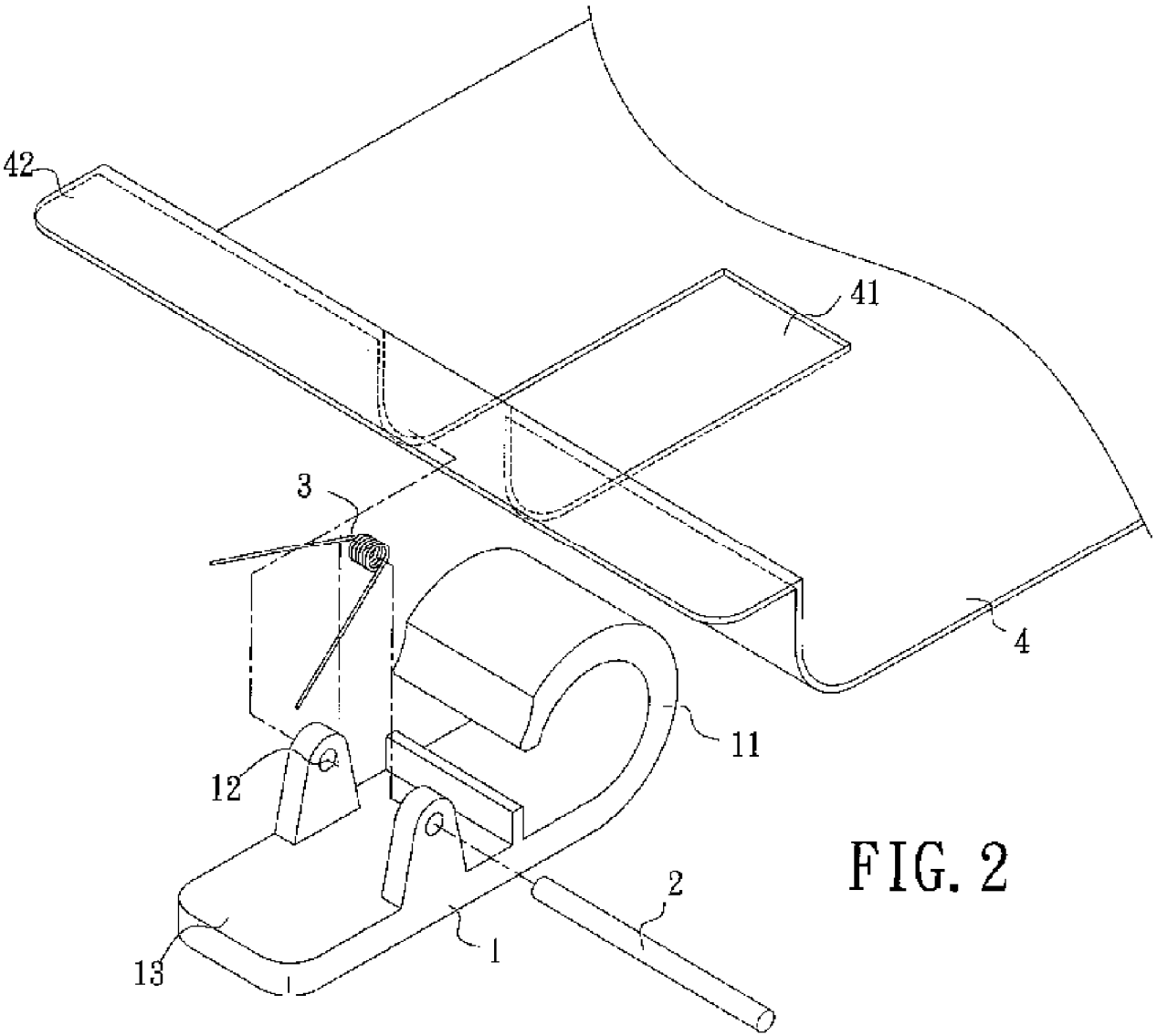
FIG. 2 is an exploded view of a safety folding device of the folding chair in accordance with the present invention.

Referring to FIG. 2, which is an exploded view of a safety folding device of the folding chair in accordance with the present invention, wherein the arc retaining portion 11 is an extension of the safety hook 1 that is roughly j-shaped. At either side of the safety hook 1 is arranged a protrusion on which is formed a pivotal hole 12 for insertion of the pin 2, the torsion spring 3 is mounted on the pin 2, and the press board 13 is located at the front terminal end of the safety hook 1.

The bottom cover 4 is roughly U-shaped and is formed at the front portion thereof with a slot 42, and both ends of the bottom cover 4 are folded to form the flange 41.

Figure 3:
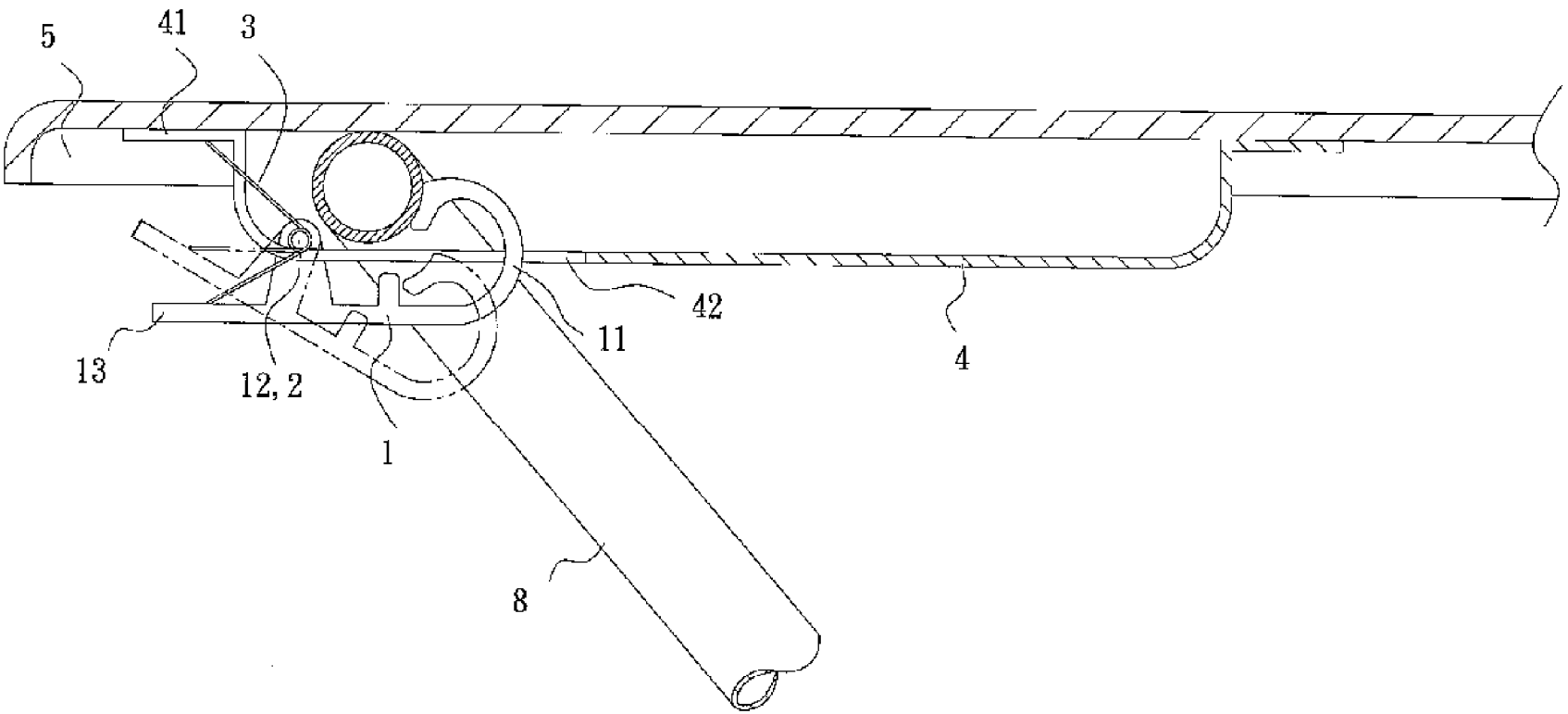
FIG. 3 is an operational view of the safety folding device in accordance with the present invention.

Referring to FIG. 3, the solid line and the dotted line show the state of the safety hook 1 before and after being pressed, respectively. Before being pressed, the folding chair is in a completely unfolded state and the safety folding device is locked to prevent the occurrence of an improper folding. And after being pressed, the folding chair is in a state ready to be folded.

The flange 41 of the bottom cover 4 is connected to the bottom of the seat 5, and the space formed between the bottom cover 4 and the flange 41 is provided for accommodation of the upper lateral pipe connected between the rear legs 8, and the hollow circular portion covered by skew lines is the upper lateral pipe connected between the rear legs 8. The pivotal holes 12 and the pin 2 are also located in the space between the bottom cover 4 and the flange 41. The arc retaining portion 11 partially protrudes out of the slot 42 of the bottom cover 4, and the press board 13 protrudes out of the bottom cover 4.

Before the press board 13 is pressed down, the arc retaining portion 11 will abut against the upper lateral pipe between the rear legs 8, in this situation, the initial torsion force of the torsion spring 3 will keep the rear legs 8 unfolded, thus preventing an undesired folding of the folding chair caused by a sudden external force acted on the rear portion of the seat 5.

After the press board 13 is pressed down, the safety hook 1 will rotate clockwise about the pin 2, the arc retaining portion 11 will lose contact with the upper lateral pipe between the rear legs 8, and the arc retaining portion 11 will almost protrude out of the slot 42 of the bottom cover 4 completely. At this moment, the deformation of the torsion spring 3 increases, and the upper lateral pipe between the rear legs 8 slides in the space of the bottom cover 4, and thus resulting in a folding of the folding chair. After the arc retaining portion 11 lose contact with the upper lateral pipe between the rear legs 8, releasing the press board 13, the torsion force of the torsion spring 3 will make the safety hook 1 return to its original position.

Referring to FIG. 4, which is an illustrative view of showing the initial state of the folding action of the folding chair. After the press board 13 is pressed down, the arc retaining portion 11 will rotate clockwise, and the upper lateral pipe between the rear legs 8 will slide right, and thus the seat 5 will turn upward. Since the front legs 7 are connected pivotally to the rear legs 8 via the pivotal shaft 9, when the seat 5 turns upward, the angle between the front legs 7 and the rear legs 8 will decrease, namely, the two pairs of legs will move closer to each other.

Figure 5:
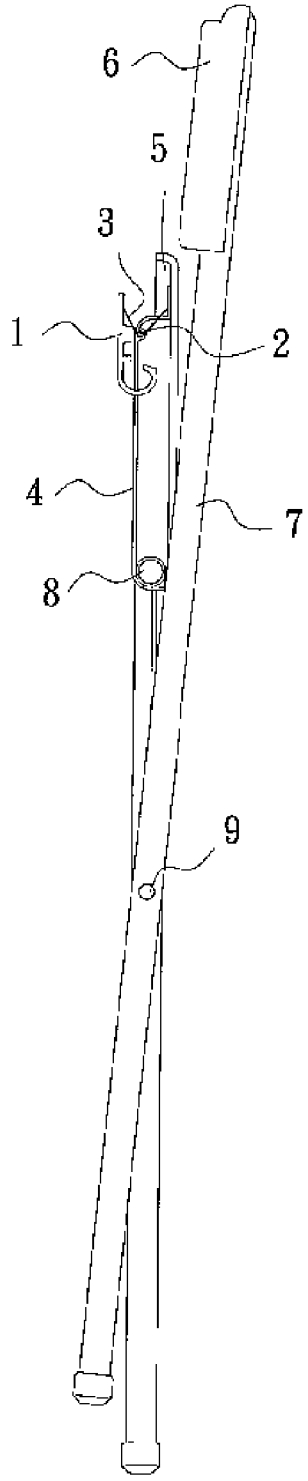
FIG. 5 shows the after-folding state of the folding chair.

Referring to FIG. 5, which shows the after-folding state of the folding chair. When the upper lateral pipe between the rear legs 8 slides to the utmost right, the seat 5 will be aligned with the rear legs 8, and the angle of the seat relative to the front legs 7 reduces to the minimum value, and thus the folding chair is folded.

Figure 6:
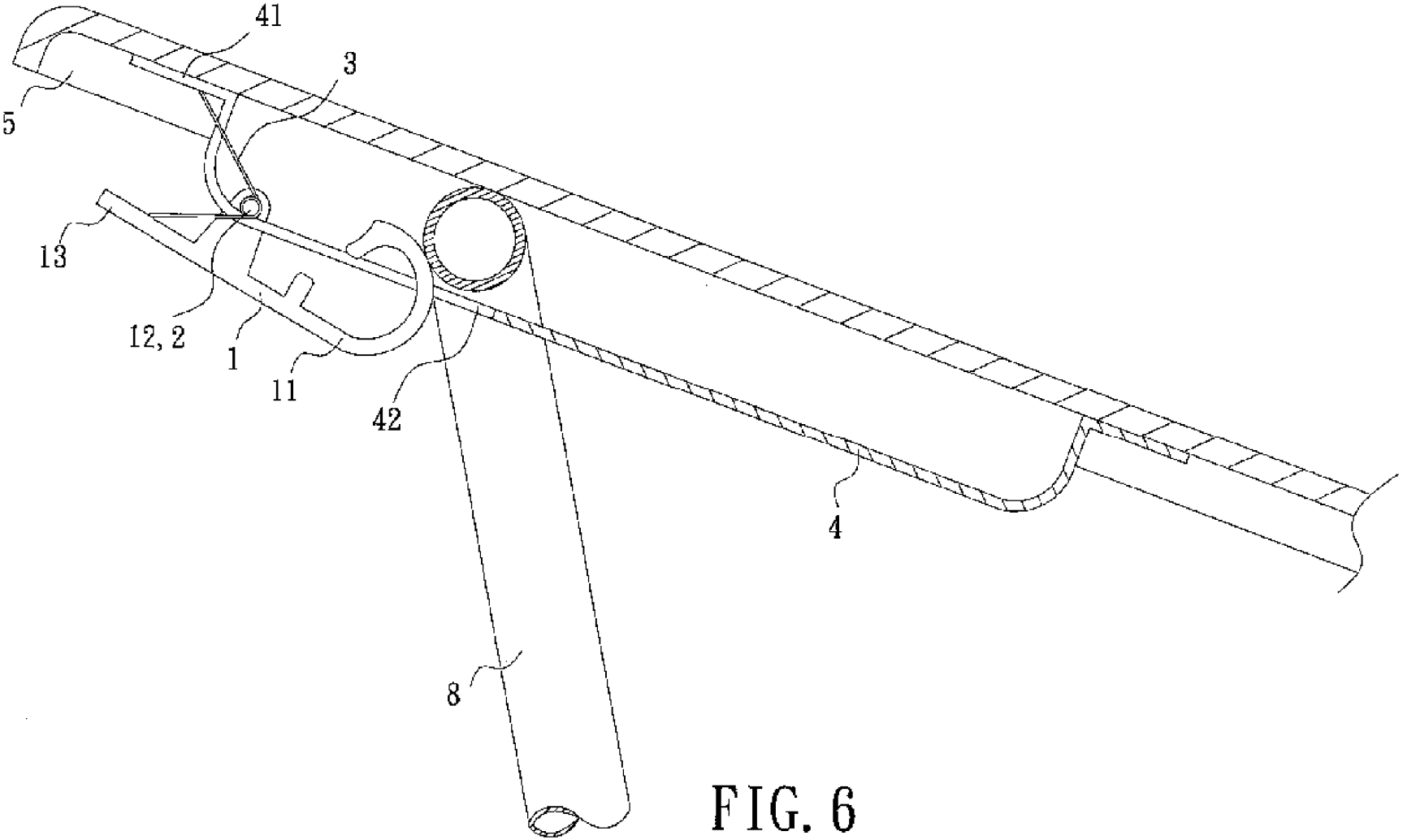
FIG. 6 is an illustrative view of showing the safety folding device is being pressed.

Referring to FIG. 6, when the folding chair is folded completely (as shown in FIG. 5), and the upper lateral pipe between the rear legs 8 slides left until it press against the arc retaining portion 11, the upper lateral pipe will rotate outward about the pin 2 by pressing against the retaining portion 11 of the safety hook 1.

Figure 7:
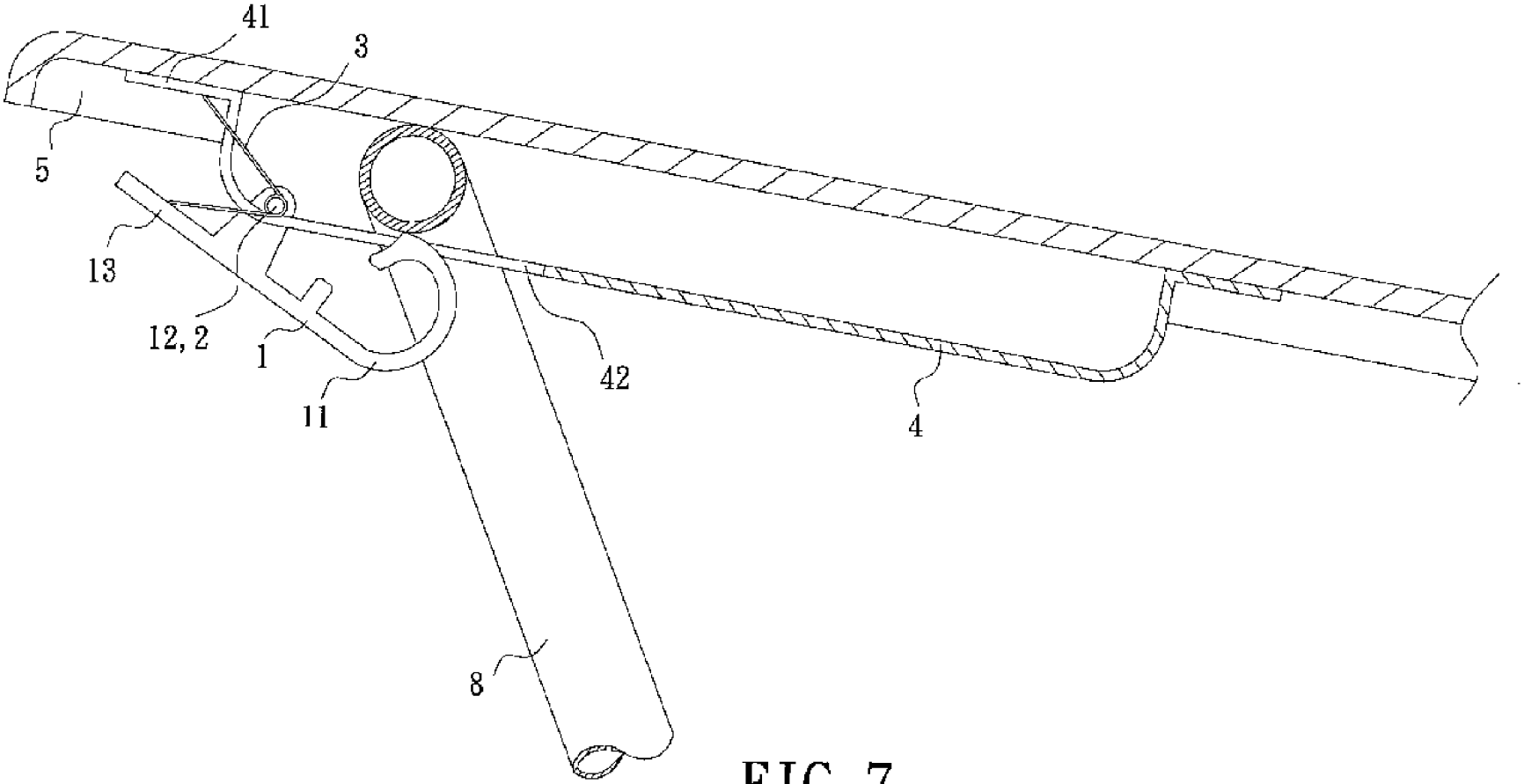
FIG. 7 is another illustrative view of showing the safety folding device is being pressed.

Referring to FIG. 7, the lateral upper lateral pipe between the rear legs 8 keeps pressing against the arc retaining portion 11 until it reaches the end thereof, at this moment, the safety hook 1 rotates outward to its utmost extent, and the deformation of the torsion spring 3 also reaches the maximum extent, and thus the folding chair is in a critical state and ready to unfold.

Figure 8:
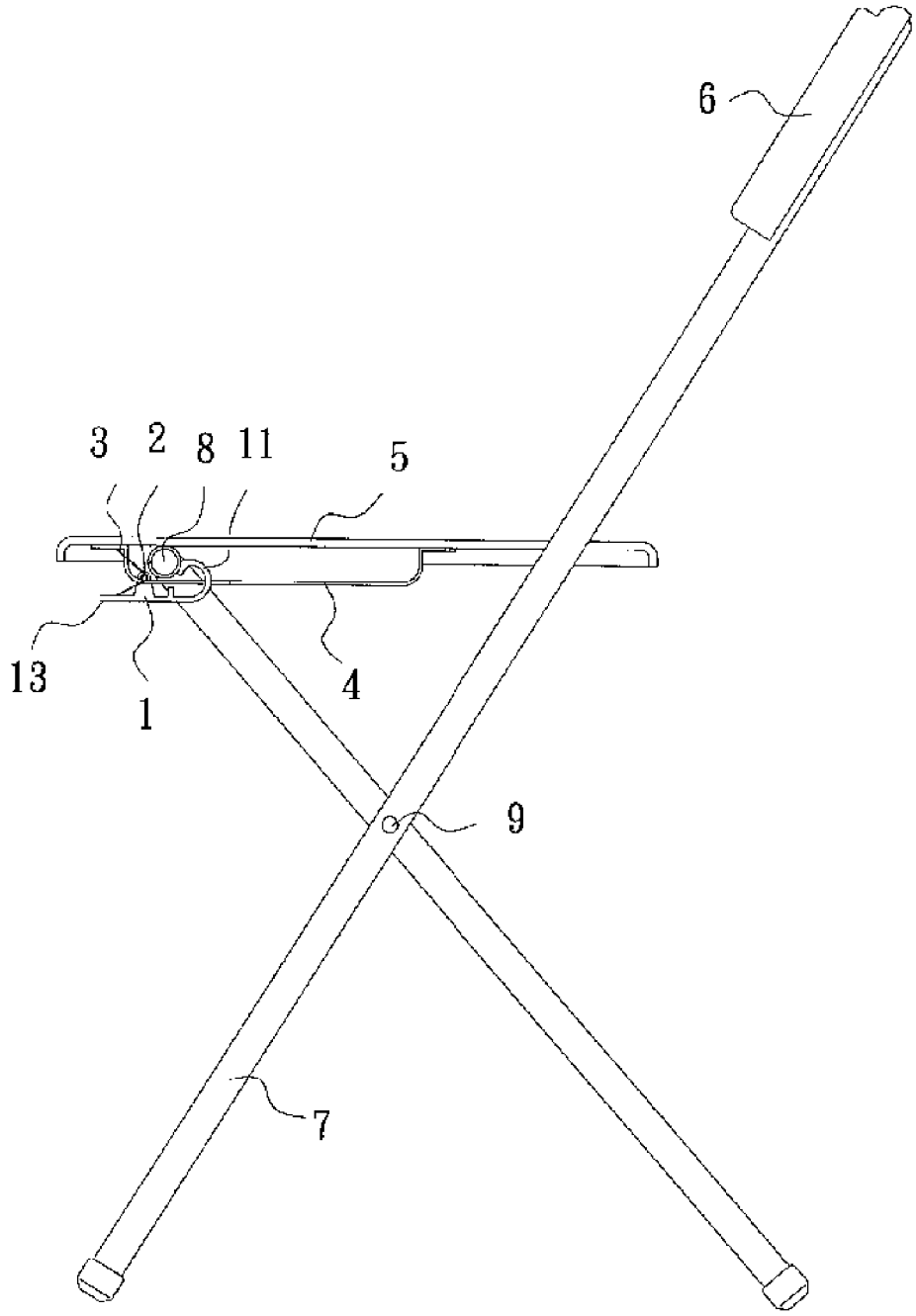
FIG. 8 shows that the folding chair is unfolded completely.
Figure 9:
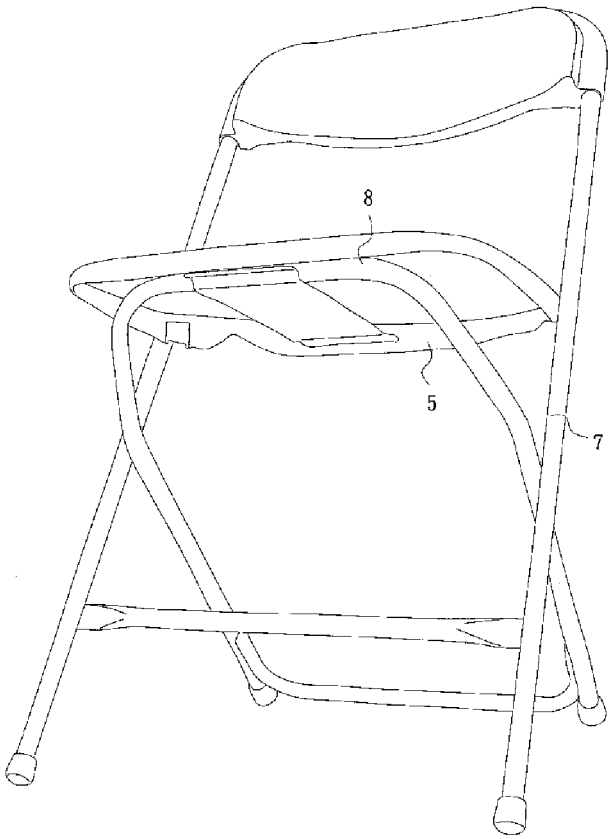
FIG. 9 shows a conventional folding chair.

Referring to FIG. 8, when the lateral upper lateral pipe between the rear legs 8 continues to move left to its utmost extent, the arc retaining portion 11 will press against the lateral upper lateral pipe between the rear legs 8 again, and the safety hook 1 returns to its original position, and thus the folding chair is completely unfolded and the safety folding device is locked to prevent the occurrence of an improper folding.

While we have shown and described various embodiments in accordance with the present invention, it should be clear to those skilled in the art that further embodiments may be made without departing from the scope of the present invention.

What is claimed is:

1. A folding chair with safety folding device comprising a pair of front legs, a pair of rear legs, a front crossbar, a rear crossbar, a pivotal shaft, a back, a safety book, a pin, a torsion spring, a bottom cover, and a seat;

wherein the front crossbar is attached to a lower portion of the front legs;

wherein the rear crossbar is attached to a lower portion of the rear legs;

wherein the pivotal shaft connects one of the pair of front legs to a corresponding one of the pair of rear legs;

wherein the back is located at a top of the front legs;

wherein the safety hook is employed to position the pair of rear legs after the folding chair is unfolded, and when the folding chair is being folded, the pair of rear legs can be released safely by pressing the safety hook, thus preventing an undesired pinching injury as a result of improper operation or impact;

wherein the safety hook is a J-shaped unitary structure and is formed at a front end thereof with an arc retaining portion;

wherein a pivotal hole is formed at a mid portion of the safety hook for insertion of the pin;

wherein a press board is formed at a rear portion of the safety hook to be pressed by a user;

wherein the pin is a cylinder to be inserted in the pivotal hole, and both ends of the pin are located in the bottom cover; and wherein the torsion spring is mounted on the pin;

and wherein the bottom cover is a U-shaped piece mounted to a bottom of the seat and is formed at a front portion thereof with a slot, and both ends of the bottom cover are folded to form a flange connected to the bottom of the seat of the folding chair.

2. The folding chair with safety folding device as claimed in claim 1, wherein the arc retaining portion is abutted by an upper lateral pipe connected between the pair of rear legs when the folding chair is being unfolded.

3. The folding chair with safety folding device as claimed in claim 1, wherein the torsion spring serves to provide a positioning force for positioning the folding chair after the folding chair is unfolded.

4. The folding chair with safety folding device as claimed in claim 1, wherein the front and rear legs of the folding chair serve to support the user together after the folding chair is unfolded.

5. The folding chair with safety folding device as claimed in claim 1, wherein the back of the folding chair is located at a top of the front legs for backing the user.

6. The folding chair with safety folding device as claimed in claim 1, wherein the front and rear legs are able to pivot about the pivotal shaft.

7. The folding chair with safety folding device as claimed in claim 4, wherein the front legs serve to support a weight of a rear portion of the seat.

8. The folding chair with safety folding device as claimed in claim 4, wherein the rear legs serve to support a weight of a front portion of the seat, and the upper lateral pipe connected between the pair of rear legs is received in a space between the seat and the bottom cover.

* * * * *